US009785101B2

(12) United States Patent
Ujiie et al.

(10) Patent No.: US 9,785,101 B2
(45) Date of Patent: Oct. 10, 2017

(54) FIXING DEVICE HAVING SLIDER TO POLISH AND FINISH FIXING ROTATOR

(71) Applicants: Masateru Ujiie, Kanagawa (JP); Naoto Suzuki, Kanagawa (JP); Shinichi Namekata, Kanagawa (JP); Takashi Sakamaki, Kanagawa (JP); Teppei Kawata, Kanagawa (JP)

(72) Inventors: Masateru Ujiie, Kanagawa (JP); Naoto Suzuki, Kanagawa (JP); Shinichi Namekata, Kanagawa (JP); Takashi Sakamaki, Kanagawa (JP); Teppei Kawata, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/267,461

(22) Filed: Sep. 16, 2016

(65) Prior Publication Data

US 2017/0090368 A1 Mar. 30, 2017

(30) Foreign Application Priority Data

Sep. 28, 2015 (JP) ..... 2015-190468
Dec. 21, 2015 (JP) ..... 2015-248092
Sep. 9, 2016 (JP) ..... 2016-176031

(51) Int. Cl.
*G03G 15/20* (2006.01)

(52) U.S. Cl.
CPC ..... *G03G 15/2053* (2013.01); *G03G 15/2025* (2013.01); *G03G 15/2075* (2013.01); *G03G 2215/2016* (2013.01)

(58) Field of Classification Search
CPC ..... G03G 15/2053; G03G 15/2025; G03G 15/2075; G03G 21/0058; G03G 2215/2009; G03G 2215/2016; G03G 2221/0089
(Continued)

(56) References Cited

U.S. PATENT DOCUMENTS 8,078,091 B2 * 12/2011 Russel ..... G03G 15/2032 399/328
9,405,244 B1 * 8/2016 Kitagawa ..... G03G 15/2053
(Continued)

FOREIGN PATENT DOCUMENTS

JP 61090181 A * 5/1986 ..... G03G 15/2032
JP 09160425 A * 6/1997
(Continued)

*Primary Examiner* — Robert Beatty
(74) *Attorney, Agent, or Firm* — Harness, Dickey & Pierce, P.L.C.

(57) ABSTRACT

A fixing device includes a fixing rotator and a slider that slides over the fixing rotator. A cam presses the slider against the fixing rotator. The cam includes a cam rear disposed opposite a rear end of the fixing rotator in an axial direction thereof and a cam front disposed opposite a front end of the fixing rotator in the axial direction thereof. A controller rotates the cam to a first slide position where the cam rear presses the slider against the fixing rotator, a second slide position where the cam rear and the cam front press the slider against the fixing rotator, a third slide position where the cam front presses the slider against the fixing rotator, and an isolation position where the cam rear and the cam front do not press the slider against the fixing rotator.

16 Claims, 7 Drawing Sheets

(58) Field of Classification Search
USPC ..... 399/327, 329, 330, 347; 219/216
See application file for complete search history.

(56) References Cited

U.S. PATENT DOCUMENTS

| | | | | |
|---|---|---|---|---|
| 2010/0158553 | A1* | 6/2010 | Ueno | G03G 15/2064 399/67 |
| 2012/0224893 | A1 | 9/2012 | Yamamoto et al. | |
| 2013/0164056 | A1 | 6/2013 | Imada et al. | |
| 2013/0189008 | A1 | 7/2013 | Ishii et al. | |
| 2014/0212188 | A1 | 7/2014 | Watanabe | |
| 2015/0323892 | A1 | 11/2015 | Sakamaki et al. | |
| 2016/0004199 | A1 | 1/2016 | Suzuki et al. | |
| 2016/0124357 | A1 | 5/2016 | Ujiie et al. | |
| 2016/0124361 | A1 | 5/2016 | Watanabe et al. | |
| 2016/0202646 | A1 | 7/2016 | Suzuki et al. | |

FOREIGN PATENT DOCUMENTS

| | | | |
|---|---|---|---|
| JP | 2005326594 | A * | 11/2005 |
| JP | 2014-149344 | | 8/2014 |
| JP | 2014-164074 | | 9/2014 |

* cited by examiner

FIXING DEVICE HAVING SLIDER TO POLISH AND FINISH FIXING ROTATOR

CROSS-REFERENCE TO RELATED APPLICATIONS

This patent application is based on and claims priority pursuant to 35 U.S.C. §119 to Japanese Patent Application Nos. 2015-190468, filed on Sep. 28, 2015, 2015-248092, filed on Dec. 21, 2015, and 2016-176031, filed on Sep. 9, 2016, in the Japanese Patent Office, the entire disclosure of each of which is hereby incorporated by reference herein.

BACKGROUND

Technical Field

Example embodiments generally relate to a fixing device and an image forming apparatus, and more particularly, to a fixing device for fixing a toner image on a recording medium and an image forming apparatus incorporating the fixing device.

Background Art

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and an opposed rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the opposed rotator apply heat and pressure to the recording medium, melting and fixing the toner image on the recording medium.

SUMMARY

At least one embodiment provides a novel fixing device that includes a fixing rotator rotatable in a given direction of rotation and an opposed rotator to press against the fixing rotator to form a fixing nip therebetween, through which a recording medium bearing a toner image is conveyed. A slider is rotatable to slide over an outer circumferential surface of the fixing rotator to polish and finish the fixing rotator. A cam is rotatable to press the slider against the outer circumferential surface of the fixing rotator. The cam includes a cam rear disposed opposite a rear end of the fixing rotator in an axial direction thereof and a cam front disposed opposite a front end of the fixing rotator in the axial direction thereof. A controller, coupled to the cam, rotates the cam to a first slide position where the cam rear presses the slider against the fixing rotator, a second slide position where the cam rear and the cam front press the slider against the fixing rotator, a third slide position where the cam front presses the slider against the fixing rotator, and an isolation position where the cam rear and the cam front do not press the slider against the fixing rotator.

At least one embodiment provides a novel image forming apparatus that includes an image forming device to form a toner image and a fixing device, disposed downstream from the image forming device in a recording medium conveyance direction, to fix the toner image on a recording medium. The fixing device includes a fixing rotator rotatable in a given direction of rotation and an opposed rotator to press against the fixing rotator to form a fixing nip therebetween, through which the recording medium bearing the toner image is conveyed. A slider is rotatable to slide over an outer circumferential surface of the fixing rotator to polish and finish the fixing rotator. A cam is rotatable to press the slider against the outer circumferential surface of the fixing rotator. The cam includes a cam rear disposed opposite a rear end of the fixing rotator in an axial direction thereof and a cam front disposed opposite a front end of the fixing rotator in the axial direction thereof. A controller, coupled to the cam, rotates the cam to a first slide position where the cam rear presses the slider against the fixing rotator, a second slide position where the cam rear and the cam front press the slider against the fixing rotator, a third slide position where the cam front presses the slider against the fixing rotator, and an isolation position where the cam rear and the cam front do not press the slider against the fixing rotator.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
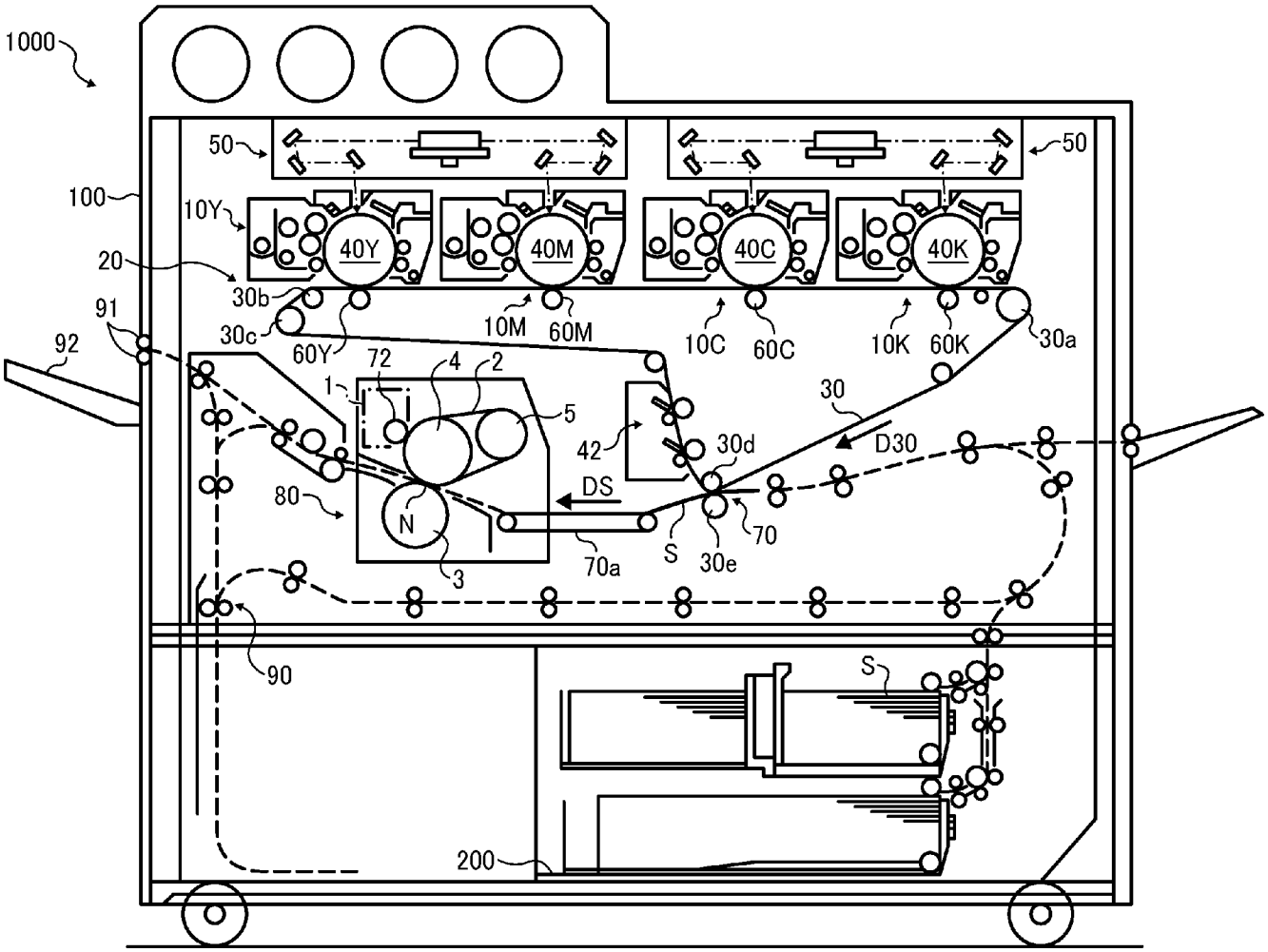
FIG. 1 is a schematic vertical cross-sectional view of an image forming apparatus according to an example embodiment of the present disclosure.

The accompanying drawings are intended to depict example embodiments and should not be interpreted to limit the scope thereof. The accompanying drawings are not to be considered as drawn to scale unless explicitly noted.

DETAILED DESCRIPTION

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, a term such as "below" can encompass both an orientation of above and below The device may be otherwise oriented (rotated 90 degrees or at other orientations) and the spatially relative descriptors used herein are interpreted accordingly.

Although the terms first, second, and the like may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present disclosure.

The terminology used herein is for the purpose of describing particular embodiments only and is not intended to be limiting of the present disclosure. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 1000 according to an example embodiment is explained.

FIG. 1 is a schematic vertical cross-sectional view of the image forming apparatus 1000. The image forming apparatus 1000 may be a copier, a facsimile machine, a printer, a multifunction peripheral or a multifunction printer (MFP) having at least one of copying, printing, scanning, facsimile, and plotter functions, or the like. According to this example embodiment, the image forming apparatus 1000 is a color printer that forms a color toner image on a recording medium by electrophotography. Alternatively, the image forming apparatus 1000 may be a monochrome printer that forms a monochrome toner image on a recording medium.

Referring to FIG. 1, a description is provided of a construction of the image forming apparatus 1000.

As illustrated in FIG. 1, the image forming apparatus 1000 is a printer employing a tandem intermediate transfer system. The image forming apparatus 1000 includes a body 100 and a sheet table 200 mounting the body 100. The body 100 includes a tandem image forming portion 20 employing the tandem intermediate transfer system. The tandem image forming portion 20 includes a plurality of image forming devices 10Y, 10M, 10C, and 10K aligned horizontally. Suffixes Y, M, C, and K represent yellow, magenta, cyan, and black, respectively.

An intermediate transfer belt 30 (e.g., an endless belt) is situated in a substantially center portion of the body 100. The intermediate transfer belt 30 is looped over a plurality of support rollers 30*a*, 30*b*, 30*c*, and 30*d* and rotatable clockwise in FIG. 1 in a rotation direction D30. On the left of the support roller 30*d* is an intermediate transfer belt cleaner 42 that cleans the intermediate transfer belt 30. The intermediate transfer belt cleaner 42 removes residual toner failed to be transferred onto a sheet S and therefore remaining on the intermediate transfer belt 30 therefrom.

Above an upper face of the intermediate transfer belt 30 stretched taut across the support rollers 30*a* and 30*b* are the four image forming devices 10Y, 10M, 10C, and 10K aligned horizontally in the rotation direction D30 of the intermediate transfer belt 30 to form yellow, magenta, cyan, and black toner images, respectively, thus constituting the tandem image forming portion 20. The image forming devices 10Y, 10M, 10C, and 10K of the tandem image forming portion 20 include photoconductive drums 40Y, 40M, 40C, and 40K serving as image bearers that bear yellow, magenta, cyan, and black toner images, respectively.

Above the tandem image forming portion 20 are two exposure devices 50. The left exposure device 50 is disposed opposite the two image forming devices 10Y and 10M. The right exposure device 50 is disposed opposite the two image forming devices 10C and 10K. For example, each of the exposure devices 50 employs an optical scanning method and includes two light sources, a coupling optical system, a common optical deflector, and two scanning-imaging optical systems. Each of the two light sources includes a semiconductor laser, a semiconductor laser array, or a multi-beam light source. The common optical deflector includes a polygon mirror. The exposure devices 50 expose the photoconductive drums 40Y, 40M, 40C, and 40K, according to yellow magenta, cyan, and black image data, forming electrostatic latent images on the photoconductive drums 40Y, 40M, 40C, and 40K, respectively.

The image forming devices 10Y, 10M, 10C, and 10K further include chargers, developing devices, and photoconductive drum cleaners, respectively. Before the exposure devices 50 expose the photoconductive drums 40Y, 40M, 40C, and 40K, the chargers uniformly charge the photoconductive drums 40Y, 40M, 40C, and 40K, respectively. The developing devices develop the electrostatic latent images formed on the photoconductive drums 40Y, 40M, 40C, and 40K by the exposure devices 50 with yellow, magenta, cyan, and black toners into yellow, magenta, cyan, and black toner images, respectively. The photoconductive drum cleaners remove residual toner failed to be transferred onto the intermediate transfer belt 30 and therefore remaining on the photoconductive drums 40Y, 40M, 40C, and 40K therefrom, respectively. Primary transfer rollers 60Y, 60M, 60C, and 60K are disposed opposite the photoconductive drums 40Y, 40M, 40C, and 40K via the intermediate transfer belt 30 to form primary transfer nips between the photoconductive drums 40Y, 40M, 40C, and 40K and the intermediate transfer belt 30, respectively, where the yellow magenta, cyan, and black toner images formed on the photoconductive drums 40Y, 40M, 40C, and 40K are primarily transferred onto the intermediate transfer belt 30 as a color toner image.

Among the plurality of support rollers 30*a*, 30*b*, 30*c*, and 30*d* that supports the intermediate transfer belt 30, the support roller 30*a* is a driving roller that drives and rotates the intermediate transfer belt 30. The support roller 30*a* is coupled to a motor through a driving force transmitter (e.g., a gear, a pulley, and a belt). When forming a black toner image on the intermediate transfer belt 30, a mover moves the support rollers 30*b* and 30*c* to isolate the intermediate transfer belt 30 from the photoconductive drums 40Y, 40M, and 40C used to form the yellow, magenta, and cyan toner images, respectively.

A secondary transfer device 70 is disposed opposite the tandem image forming portion 20 via the intermediate transfer belt 30. The secondary transfer device 70 includes a secondary transfer roller 30*e*pressed against the support roller 30*d* via the intermediate transfer belt 30. The secondary transfer roller 30*e*generates a transfer electric field to secondarily transfer the color toner image formed on the intermediate transfer belt 30 onto a sheet S (e.g., a transfer sheet) serving as a recording medium conveyed from the sheet table 200, Downstream from the secondary transfer device 70 in a sheet conveyance direction DS is a fixing device 80 that fixes the color toner image transferred from the intermediate transfer belt 30 onto the sheet S thereon. The fixing device 80 includes a slide assembly 1, a fixing belt 2, a pressure roller 3, a fixing roller 4, and a heating roller 5.

A conveyance belt 70*a* supported by two rollers conveys the sheet S bearing the color toner image transferred from the intermediate transfer belt 30 by the secondary transfer device 70 to the fixing device 80. In the fixing device 80, the pressure roller 3 is pressed against the fixing roller 4 via the fixing belt 2 heated by the heating roller 5 to form a fixing nip N between the fixing belt 2 and the pressure roller 3. As the sheet S bearing the unfixed color toner image is conveyed through the fixing nip N, the fixing belt 2 and the pressure roller 3 fix the color toner image on the sheet S under heat and pressure. Instead of the conveyance belt 70*a*, a stationary guide, a conveyance roller, or the like may be used. Below the secondary transfer device 70 and the fixing device 80 is a sheet reverse device 90 disposed in parallelism with the tandem image forming portion 20. The sheet reverse device 90 reverses and conveys the sheet S for duplex printing to print another toner image on a back side of the sheet S. The sheet S bearing the fixed color toner image is ejected by an output roller pair 91 onto an output tray 92.

A description is provided of a construction of a comparative fixing device.

The comparative fixing device includes a polishing roller serving as a polisher that slides over and polishes an outer circumferential surface of a fixing belt, thus recovering an appropriate surface property of the outer circumferential surface of the fixing belt. As a sheet is conveyed over the outer circumferential surface of the fixing belt, a lateral edge of the sheet in a width direction thereof may damage the fixing belt. The polishing roller is used to suppress formation of faulty gloss degradation streaks on a toner image on a subsequent sheet caused by the damaged fixing belt. The polishing roller has an outer circumferential surface that polishes the outer circumferential surface of the fixing belt while the polishing roller slides over the fixing belt.

A description is provided of the faulty gloss degradation streaks.

The faulty gloss degradation streaks are also called vertical streaks. As a plurality of small sheets having an identical size is conveyed over the fixing belt continuously, burrs on the lateral edge of each sheet may damage the fixing belt with vertical streaks on the fixing belt. When a large sheet greater than the small sheets is conveyed over the fixing belt, the vertical streaks on the fixing belt may produce faulty gloss degradation streaks on a toner image on the large sheet.

Since the lateral edge of the sheet in the width direction thereof has burrs produced by machine cut, as the plurality of sheets having an identical size is conveyed over the fixing belt continuously, the burrs of each sheet come into contact with the fixing belt at an identical linear position thereon. The burrs of the sheet vary in direction and height between a rear lateral edge and a front lateral edge of the sheet in the width direction thereof. As the burrs varying between the rear lateral edge and the front lateral edge of the sheet roughen the outer circumferential surface of the fixing belt at the identical linear position thereon, the roughened outer circumferential surface of the fixing belt may produce gloss degradation streaks on the toner image, that are unsymmetrical between the rear lateral edge and the front lateral edge of the sheet, degrading the quality of the toner image. Additionally, after the polishing roller contacts the outer circumferential surface of the fixing belt, the outer circumferential surface of the fixing belt may suffer from faulty linear streaks in a sheet conveyance direction.

While the polishing roller contacts the fixing belt, the polishing roller is driven and rotated to slide over the fixing belt. In order to prevent the damaged fixing belt from producing the faulty gloss degradation streaks on the toner image, which may degrade glossiness of the toner image, the polishing roller may polish the outer circumferential surface of the fixing belt with a slight force.

As the polishing roller polishes the fixing belt to prevent the faulty gloss degradation streaks, the polishing roller may vary a surface condition between a contact portion on the fixing belt where the polishing roller contacts the fixing belt and a non-contact portion on the fixing belt where the polishing roller does not contact the fixing belt. Such variation in the surface condition may degrade the quality of the toner image on the sheet.

In order to improve the quality of the toner image even if the polishing roller slides over and polishes the fixing belt, a slider, instead of the polishing roller, may contact the outer circumferential surface of the fixing belt to repair the roughened outer circumferential surface of the fixing belt, thus retaining a desired condition of the outer circumferential surface of the fixing belt. However, the slider contacts the fixing belt at both lateral ends of the fixing belt in the axial direction thereof simultaneously. Accordingly, even when one lateral edge of the sheet in the width direction thereof damages the fixing belt, the slider may contact both lateral ends of the fixing belt in the axial direction thereof to repair the roughened outer circumferential surface of the fixing belt. Additionally, the slider may not eliminate the faulty linear streaks extending in the sheet conveyance direction on the outer circumferential surface of the fixing belt that are caused by the slider while the slider slides over the fixing belt.

A description is provided of a construction of the fixing device 80 incorporated in the image forming apparatus 1000 having the construction described above.

The fixing device 80 has a configuration in which a slider repairs an outer circumferential surface of the fixing belt 2 that is damaged by a burred lateral edge of the sheet S in a width direction thereof parallel to an axial direction of the fixing belt 2 while the sheet S is conveyed over the fixing belt 2, so as to prevent the damaged fixing belt 2 from forming a faulty toner image having faulty gloss degradation streaks on the sheet S. Additionally, the fixing device 80 has a configuration that eliminates faulty linear streaks extending in the sheet conveyance direction DS on the fixing belt 2, which may appear as faulty linear streaks on the toner image on the sheet S. The faulty linear streaks may be caused by the slider while the slider repairs the outer circumferential surface of the fixing belt 2 damaged by the burred lateral edge of the sheet S in the width direction thereof. For example, the fixing device 80 includes a mechanism to polish the fixing belt 2 at both lateral ends or one lateral end of the fixing belt 2 in the axial direction thereof so as to repair the outer circumferential surface of the fixing belt 2 that is damaged by the burred lateral edge of the sheet S and to finish the fixing belt 2 so as to eliminate the faulty linear streaks on the fixing belt 2.

Figure 2:
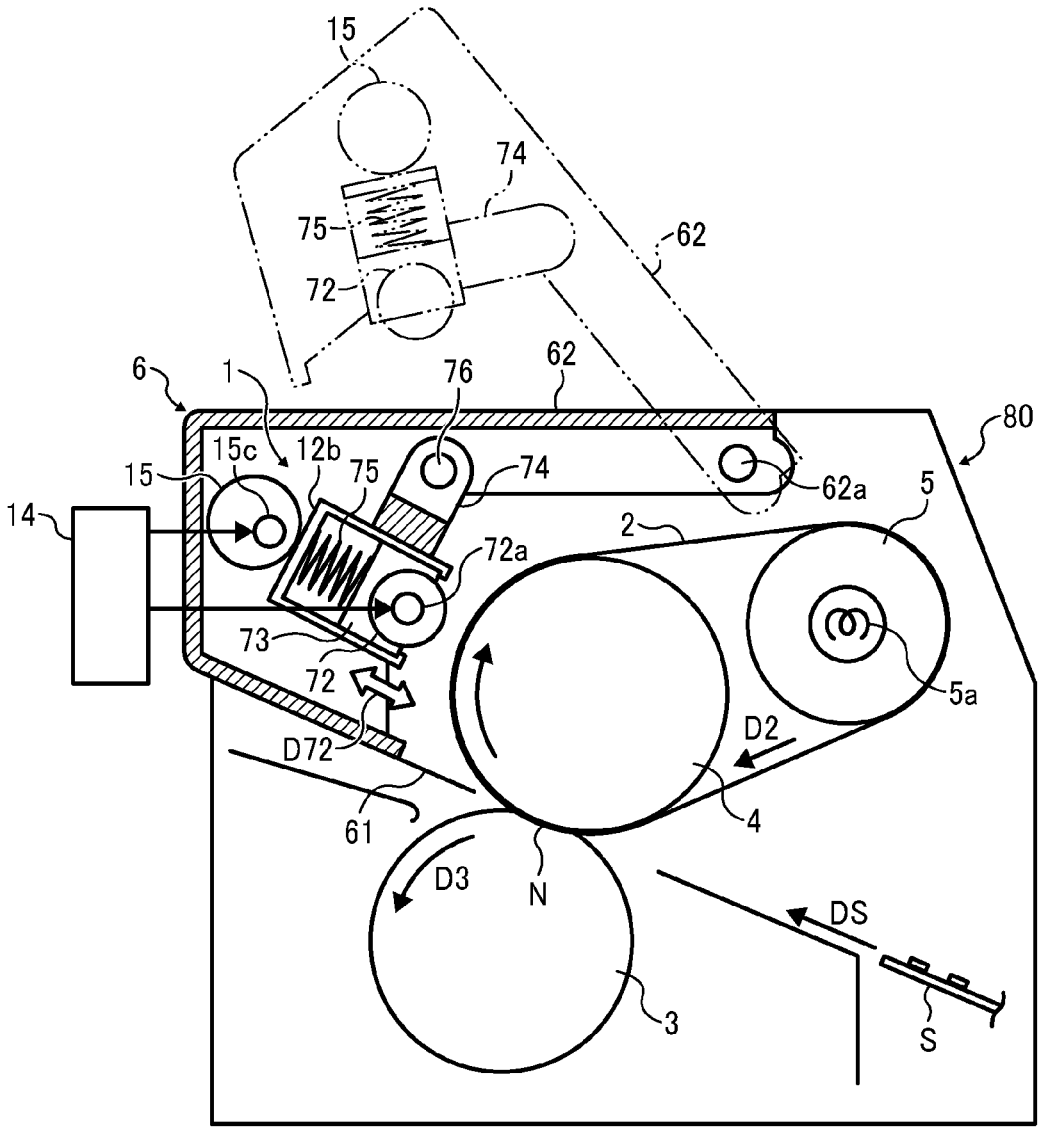
FIG. 2 is a schematic vertical cross-sectional view of a fixing device incorporated in the image forming apparatus depicted in FIG. 1.

FIG. 2 is a vertical cross-sectional view of the fixing device 80. As illustrated in FIG. 2, the fixing device 80 includes the slide assembly 1, the fixing belt 2, the pressure roller 3, the fixing roller 4, and the heating roller 5. The slide assembly 1 includes a slide roller 72. The fixing belt 2 is an endless belt serving as a fixing rotator or a fixing member that is rotatable in a rotation direction D2. The pressure roller 3 serves as a pressure rotator or an opposed rotator that is rotatable in a rotation direction D3. The fixing belt 2 is looped over the fixing roller 4 and the heating roller 5. The heating roller 5 accommodates a heater 5*a* serving as a heater or a heat source. The heater 5*a* heats the heating roller 5 which in turn heats the fixing belt 2. Thus, the fixing belt 2 accommodates the heater 5*a*. The heater 5*a* is a lamp (e.g., a halogen lamp), an induction heater, or the like.

The fixing device 80 further includes a separation plate 61 and a separator 6 that includes the slide assembly 1. The slide assembly 1 is disposed in a dead space above the separation plate 61. Hence, the fixing device 80 accommodates the slide assembly 1 without upsizing the fixing device 80. The slide assembly 1 of the separator 6 includes the slide roller 72 serving as a slider. The slide roller 72 is detachably attached to the slide assembly 1 readily. Thus, the slide roller 72 is replaced with new one or another slide roller after being used for a given time.

As illustrated in an alternate long and two short dashes line in FIG. 2, the separator 6 pivots about a pivot shaft 62*a* supported by a frame 62 such that the separator 6 separates or retracts from the fixing belt 2. For example, when the sheet S is jammed between the fixing belt 2 and the pressure roller 3 at a position in proximity to an exit of the fixing nip N, a user separates the separator 6 from the fixing belt 2 to remove the jammed sheet S from the fixing nip N readily. The separator 6 is secured to the frame 62 with a screw or the like. The screw is released from the frame 62 to allow a service engineer to remove the separator 6 from the fixing device 80. Thus, the slide roller 72 disposed inside the separator 6 is replaced with a simple process.

A driving shaft 72*a* of the slide roller 72 is supported by a beating 73 mounted on a bracket 74. The bracket 74 is pivotable about a shaft 76 serving as a pivot axis supported by the frame 62 of the separator 6. A holder 12*b* holds the bracket 74 and accommodates the bearing 73 that bears the slide roller 72 and a spring 75. The driving shaft 72*a* of the slide roller 72 is driven and rotated by a driving force from a driving controller 14 serving as a controller to control sliding of the slide roller 72 over the fixing belt 2. A cam 15 is disposed on an end of the holder 12*b*. A driving shaft 15*c* of the cam 15 is also driven and rotated by a driving force from the driving controller 14.

The driving controller 14 is a controller including a computer or a driving circuit that drives a motor. The driving controller 14 includes a memory or the like that stores data about a rotation angle of the cam 15 defined for polishing and finishing, that is, a first pressing position for polishing and a second pressing position for finishing, of the fixing belt 2 described below, that is, an angle that varies depending on pressure with which the slide roller 72 presses against the outer circumferential surface of the fixing belt 2. The driving controller 14 controls sliding of the slide roller 72 and polishing of the fixing belt 2 based on the data.

As the cam 15 rotates, the bracket 74 pivots about the shaft 76 serving as a pivot axis of the bracket 74. The slide roller 72 supported by the bracket 74 comes into contact with and separates from the fixing belt 2 in a direction D72. The cam 15 is disposed at a rear and a front of the holder 12*b* in the axial direction of the fixing belt 2. The cam 15 disposed at the rear of the holder 12*b* is asymmetrical with the cam 15 disposed at the front of the holder 12*b*. As the cam 15 pivots about the driving shaft 15*c*, the cam 15 moves to a plurality of positions to polish the fixing belt 2 as illustrated in FIGS. 3 to 6.

Figure 3:
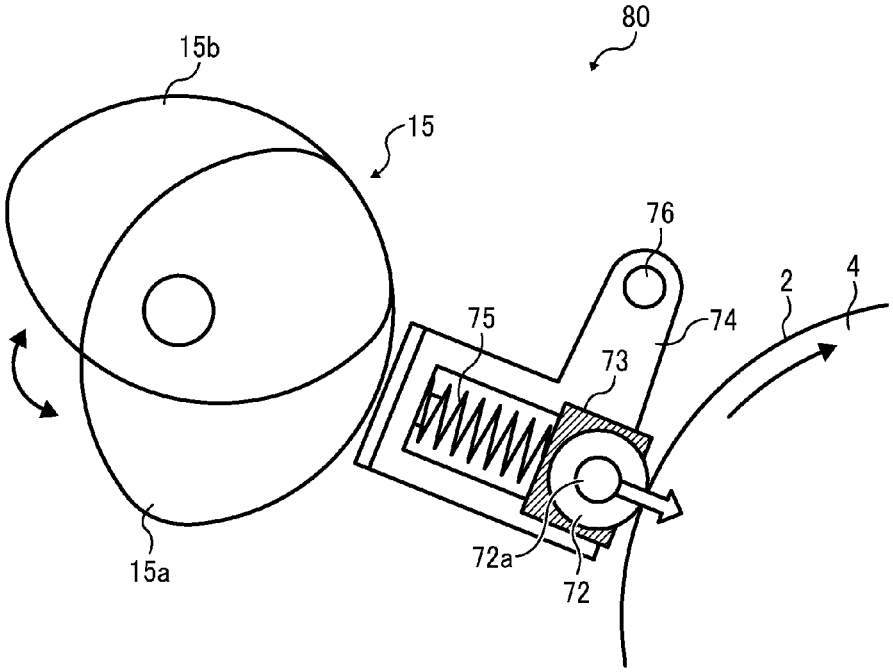
FIG. 3 is a partial vertical cross-sectional view of the fixing device depicted in FIG. 2, illustrating a first slide position of a cam incorporated in the fixing device.
Figure 4:
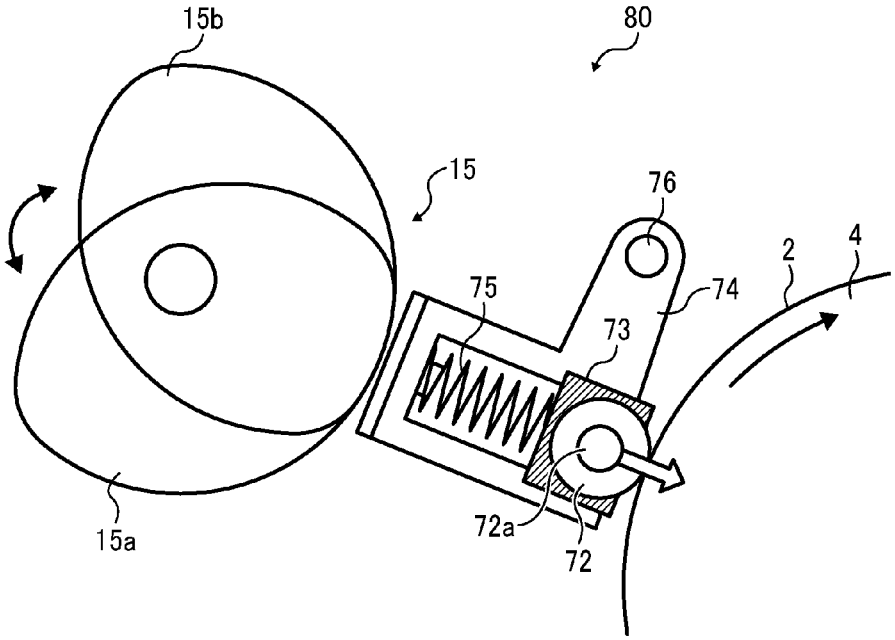
FIG. 4 is a partial vertical cross-sectional view of the fixing device depicted in FIG. 2, illustrating a second slide position of the cam incorporated in the fixing device.
Figure 5:
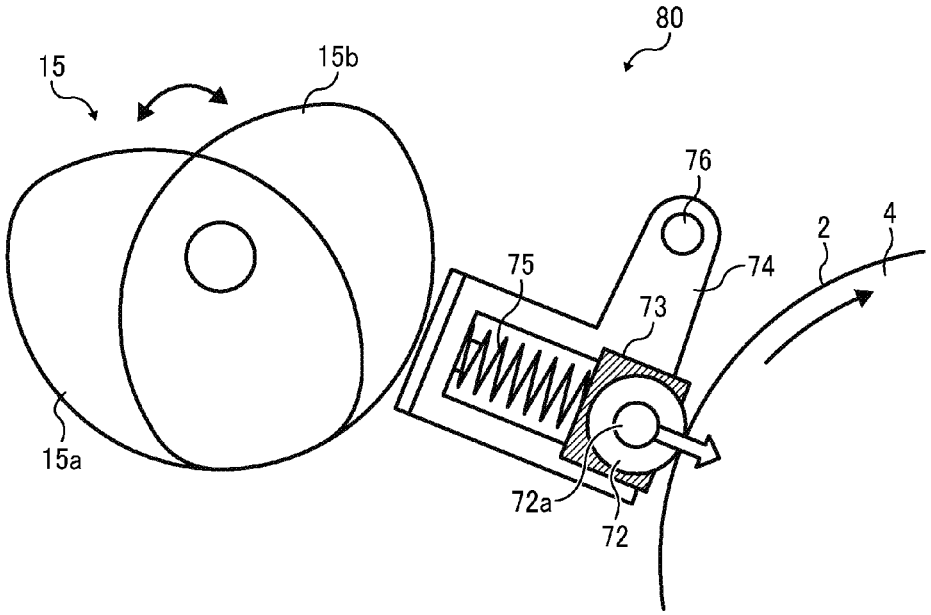
FIG. 5 is a partial vertical cross-sectional view of the fixing device depicted in FIG. 2, illustrating a third slide position of the cam incorporated in the fixing device.
Figure 6:
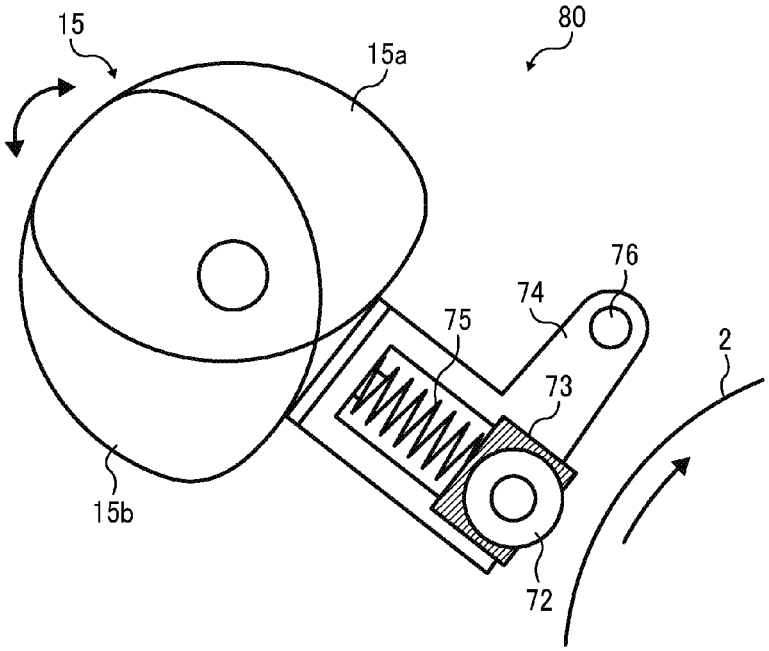
FIG. 6 is a partial vertical cross-sectional view of the fixing device depicted in FIG. 2, illustrating an isolation position of the cam incorporated in the fixing device.

As illustrated in FIGS. 3 to 6, the cam 15 includes a cam rear 15*a* and a cam front 15*b*. FIG. 3 is a partial vertical cross-sectional view of the fixing device 80, illustrating a first slide position where the cam front 15*b* does not press the slide roller 72 against the fixing belt 2 while the cam rear 15*a* presses the slide roller 72 against the fixing belt 2. FIG. 4 is a partial vertical cross-sectional view of the fixing device 80, illustrating a second slide position where the cam rear 15*a* and the cam front 15*b* press the slide roller 72 against the fixing belt 2. FIG. 5 is a partial vertical cross-sectional view of the fixing device 80, illustrating a third slide position where the cam front 15*b* presses the slide roller 72 against the fixing belt 2 while the cam rear 15*a* does not press the slide roller 72 against the fixing belt 2. FIG. 6 is a partial vertical cross-sectional view of the fixing device 80, illustrating an isolation position where the cam rear 15*a* and the cam front 15*b* do not press the slide roller 72 against the fixing belt 2. Illustration of a finishing position, that is, the second pressing position, where the slide roller 72 finishes the outer circumferential surface of the fixing belt 2 is omitted.

The slide roller 72 comes into contact with and separates from the fixing belt 2. Pressure with which the slide roller 72 presses against the outer circumferential surface of the fixing belt 2 is determined based on the rotation angle of the cam 15 and the resilience of the spring 75. The driving controller 14 coupled to the driving shaft 15*c* of the cam 15 controls the pressure with which the slide roller 72 presses against the outer circumferential surface of the fixing belt 2. Thus, the driving controller 14 selects the position of the cam 15 from the first slide position depicted in FIG. 3 where the cam rear 15*a* presses the slide roller 72 against the fixing belt 2, the second slide position depicted in FIG. 4 where the cam rear 15*a* and the cam front 15*b* press the slide roller 72 against the fixing belt 2, and the third slide position depicted in FIG. 5 where the cam front 15*b* presses the slide roller 72 against the fixing belt 2.

With the construction described above, in a state in which the slide roller 72 contacts the fixing belt 2, the driving controller 14 coupled to the driving shaft 72*a* of the slide roller 72 drives and rotates the slide roller 72, causing the slide roller 72 to slide over and polish the fixing belt 2. Accordingly, the slide roller 72 recovers a desired surface property of the outer circumferential surface of the fixing belt 2.

FIGS. 3 to 6 illustrate one example of the positions of the cam rear 15*a* and the cam front 15*b*.

Referring to FIGS. 3 to 6, a description is provided of a construction of a mechanism that brings the slide roller 72 into contact with the fixing belt 2 and separates the slide roller 72 from the fixing belt 2.

FIGS. 3 to 5 illustrate the first slide position, the second slide position, and the third slide position of the slide roller 72 that contacts the fixing belt 2.

FIG. 6 illustrates the isolation position of the slide roller 72 that is isolated from the fixing belt 2. When the slide roller 72 is at the finishing position to finish the outer circumferential surface of the fixing belt 2 polished by the slide roller 72, the cam 15 is angled relative to the holder 12*b* holding the bracket 74 at a finishing angle at which the cam 15 presses the slide roller 72 against the fixing belt 2 with decreased pressure smaller than increased pressure with which the cam 15 presses the slide roller 72 against the fixing belt 2 at a polishing position to polish the fixing belt 2 so as to eliminate the faulty gloss degradation streaks on the fixing belt 2 caused by the burred lateral edge of the sheet S. Although illustration of the cam 15 at the finishing position is omitted, the cam 15 situated at the finishing position satisfies pressure at the finishing position illustrated in FIG. 7.

As illustrated in FIG. 3, the bearing 73 rotatably supports the driving shaft 72*a* of the slide roller 72. The bracket 74 supports the bearing 73 such that the slide roller 72 is movable in the direction D72 depicted in FIG. 2 in which the slide roller 72 comes into contact with the fixing belt 2 and separates from the fixing belt 2. The spring 75 biases the slide roller 72 against the fixing belt 2 with a resilience that brings the slide roller 72 into contact with the fixing belt 2. Even if the spring 75 presses the slide roller 72 against the fixing belt 2, a stopper prevents the slide roller 72 from falling out of the bracket 74, thus retaining the slide roller 72 to project beyond the bracket 74 toward the fixing belt 2. While the slide roller 72 contacts the fixing belt 2, the spring 75 is compressed to press the slide roller 72 against the fixing belt 2 with desired pressure.

The bracket 74 pivotable about the shaft 76 is attached to a case (e.g., the frame 62) of a separation unit (e.g., the separator 6). The bracket 74 contacts the cam 15 disposed opposite the slide roller 72 via the spring 75. A torsion coil spring exerts a resilience, that is, a pivot force, to the bracket 74 to cause the bracket 74 to pivot about the shaft 76 clockwise in FIG. 3 in a separation direction in which the slide roller 72 separates from the fixing belt 2. The resilience generated by the torsion coil spring retains the bracket 74 to contact the cam 15, allowing the bracket 74 to move in accordance with rotation of the cam 15. As the cam 15 rotates, the cam 15 moves the slide roller 72 to a contact position (e.g., the first slide position depicted in FIG. 3, the second slide position depicted in FIG. 4, and the third slide position depicted in FIG. 6) where the slide roller 72 contacts the fixing belt 2 and the isolation position depicted in FIG. 6 where the slide roller 72 is isolated from the fixing belt 2. The cam 15 is driven and rotated by a driving force from the driving controller 14.

Figure 7:
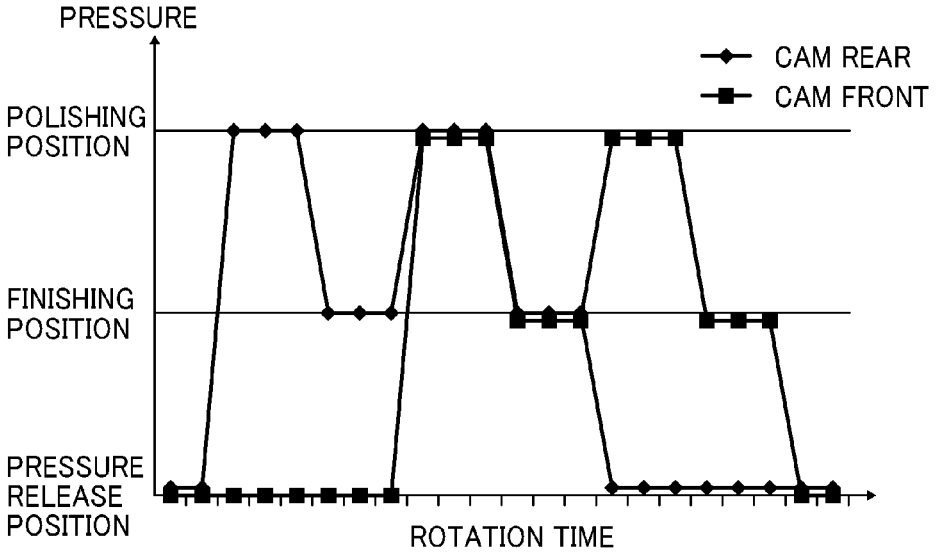
FIG. 7 is a graph illustrating a relation between a rotation time of the cam depicted in FIGS. 3 to 6 and pressure with which a slide roller presses against a fixing belt incorporated in the fixing device depicted in FIG. 2.

FIG. 7 is a graph illustrating a relation between a rotation time of the cam 15 and pressure with which the slide roller 72 presses against the fixing belt 2. FIG. 7 illustrates pressure that varies as the cam 15 rotates and moves to the first slide position depicted in FIG. 3, the second slide position depicted in FIG. 4, the third slide position depicted in FIG. 5, and the isolation position depicted in FIG. 6.

As the cam 15 rotates and moves to the first slide position depicted in FIG. 3, the cam rear 15*a* presses the slide roller 72 against the fixing belt 2 while the cam front 15*b* does not press the slide roller 72 against the fixing belt 2. As the cam 15 rotates further and moves to the second slide position depicted in FIG. 4, both the cam rear 15*a* and the cam front 15*b* press the slide roller 72 against the fixing belt 2. As the cam 15 rotates further and moves to the third slide position depicted in FIG. 5, the cam front 15*b* presses the slide roller 72 against the fixing belt 2 while the cam rear 15*a* does not press the slide roller 72 against the fixing belt 2. As the cam 15 rotates further and moves to the isolation position depicted in FIG. 6, both the cam rear 15*a* and the cam front 15*b* do not press the slide roller 72 against the fixing belt 2. Additionally, FIG. 7 illustrates a difference in pressure (e.g., an engagement amount of the slide roller 72 engaging the fixing belt 2) with which the slide roller 72 presses against the fixing belt 2 between the polishing position and the finishing position of the cam 15. At the polishing position, the cam 15 presses the slide roller 72 against the fixing belt 2 with the increased pressure to polish the fixing belt 2 damaged by the burred lateral edge of the sheet S in the width direction thereof. At the finishing position, the cam 15 presses the slide roller 72 against the fixing belt 2 with the decreased pressure smaller than the increased pressure to finish the fixing belt 2 after the slide roller 72 polishes the fixing belt 2.

Figure 8:
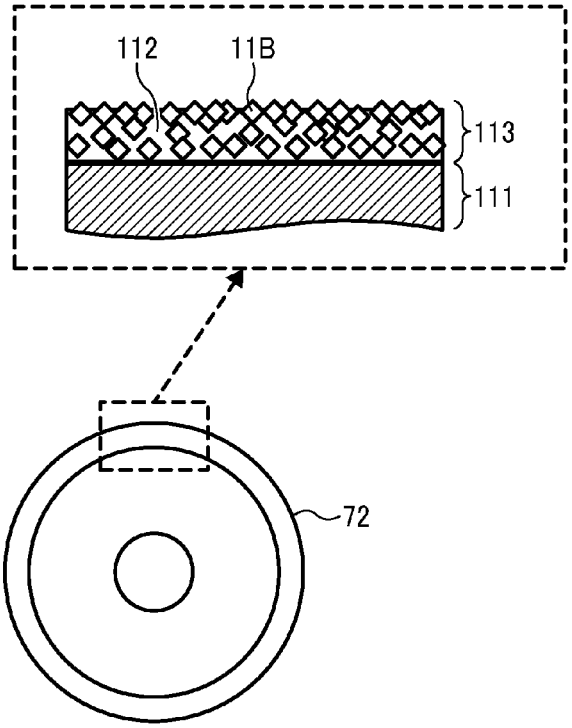
FIG. 8 is a cross-sectional view of the slide roller incorporated in the fixing device depicted in FIG. 2.

FIG. 8 is a cross-sectional view of the slide roller 72 serving as a slider. While the cam 15 presses the slide roller 72 against the fixing belt 2 with the given pressure as described above, the slide roller 72 rotates in a forward direction corresponding to the rotation direction D2 of the fixing belt 2 or a reverse direction against the rotation direction D2 of the fixing belt 2 with a linear speed differential between a rotation speed of the slide roller 72 and a rotation speed of the fixing belt 2. For example, the driving controller 14 rotates the slide roller 72 at a rotation speed higher than a rotation speed of the fixing belt 2. As illustrated in FIG. 8, the slide roller 72 includes a cored bar 111 and an abrasive grain layer 113 mounted on the cored bar 111. The abrasive grain layer 113 includes a binder resin 112 and abrasive grains 11B dispersed in the binder resin 112. The abrasive grains 11B project from an outer circumferential surface of the abrasive grain layer 113 to define slight surface asperities.

Figure 9:
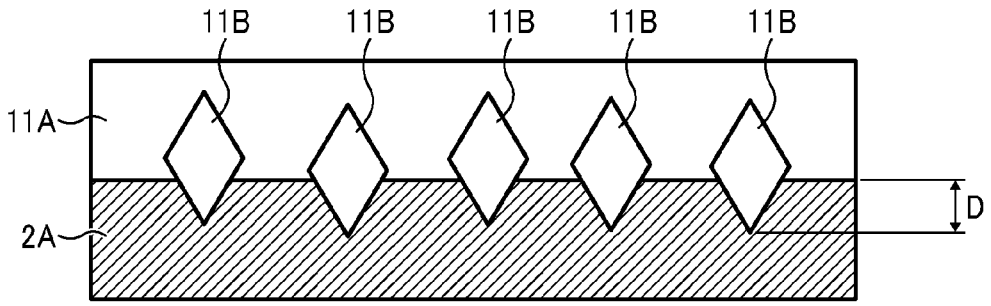
FIG. 9 is a cross-sectional view of an outer circumferential surface of the fixing belt and an outer circumferential surface of the slide roller when the cam depicted in FIGS. 3 to 5 is at a polishing position.
Figure 10:
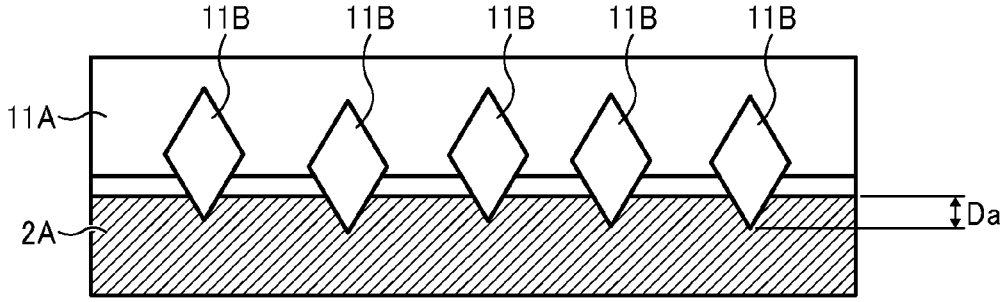
FIG. 10 is a cross-sectional view of the outer circumferential surface of the fixing belt and the outer circumferential surface of the slide roller when the cam depicted in FIGS. 3 to 5 is at a finishing position.

FIG. 9 is a cross-sectional view of an outer circumferential surface 2A of the fixing belt 2 and an outer circumferential surface 11A of the slide roller 72 contacting the fixing belt 2 when the cam 15 is at the polishing position to repair the fixing belt 2 damaged by the burred lateral edge of the sheet S in the width direction thereof. FIG. 10 is a cross-sectional view of the outer circumferential surface 2A of the fixing belt 2 and the outer circumferential surface 11A of the slide roller 72 contacting the fixing belt 2 when the cam 15 is at the finishing position. As the slide roller 72 presses against the fixing belt 2 with the increased pressure at the polishing position, the slide roller 72 (e.g., the abrasive grains 11B) engages the fixing belt 2 with an increased engagement amount D as illustrated in FIG. 9. Conversely, as the slide roller 72 presses against the fixing belt 2 with the decreased pressure at the finishing position, the slide roller 72 (e.g., the abrasive grains 11B) engages the fixing belt 2 with a decreased engagement amount Da smaller than the increased engagement amount D as illustrated in FIG. 10.

A description is provided of advantages of the fixing device 80.

As illustrated in FIG. 2, the fixing device 80 (e.g., a fuser or a fusing unit) includes a fixing rotator (e.g., the fixing belt 2) rotatable in a given direction of rotation (e.g., the rotation direction D2) and an opposed rotator (e.g., the pressure roller 3) pressed against the fixing rotator to form the fixing nip N therebetween, through which a recording medium (e.g., a sheet S) bearing a toner image is conveyed. As the recording medium bearing the toner image is conveyed through the fixing nip N in a recording medium conveyance direction(e.g., the sheet conveyance direction DS), the fixing rotator and the opposed rotator fix the toner image on the recording medium.

The fixing device 80 further includes a slider (e.g., the slide roller 72), a cam (e.g., the cam 15), and a controller (e.g., the driving controller 14). The rotatable slider slides over and polishes an outer circumferential surface of the fixing rotator to recover an appropriate surface property of the fixing rotator. The cam presses the slider against the outer circumferential surface of the fixing rotator. The cam includes a cam rear (e.g., the cam rear 15*a*) disposed opposite a rear end of the fixing rotator in an axial direction thereof and a cam front (e.g., the cam front 15*b*) disposed opposite a front end of the fixing rotator in the axial direction thereof. The controller rotates the cam to the first slide position where the cam rear presses the slider against the fixing rotator, the second slide position where the cam rear and the cam front press the slider against the fixing rotator, the third slide position where the cam front presses the slider against the fixing rotator, and the isolation position where the cam rear and the cam front do not press the slider against the fixing rotator.

Accordingly, even if a burred lateral edge of the recording medium in a width direction thereof roughens the outer circumferential surface of the fixing rotator at one of the rear end and the front end of the fixing rotator in the axial direction thereof, the slider repairs the roughened outer circumferential surface of the fixing rotator at the one of the rear end and the front end of the fixing rotator, thus effectively preventing the roughened outer circumferential surface of the fixing rotator from producing faulty gloss degradation streaks on the toner image on the recording medium, which may degrade glossiness of the toner image.

Additionally, the slider selectively repairs one or both of the rear end and the front end of the fixing rotator, which suffers from surface roughness. For example, the slider does not repair another one of the rear end and the front end of the fixing rotator, which does not suffer from surface roughness, improving durability of the fixing rotator. Further, since the controller changes pressure with which the slider presses against the fixing rotator, the slider eliminates faulty linear streaks extending on the outer circumferential surface of the fixing rotator in the direction of rotation of the fixing rotator, which are produced by the slider sliding over the fixing rotator, thus preventing the faulty gloss degradation streaks from appearing on the toner image on the recording medium.

The slider selectively recovers the fixing rotator from surface roughness at one lateral end (e.g., one of the rear end and the front end) of the fixing rotator in the axial direction thereof. Alternatively, the slider may recover the fixing rotator from surface roughness at both lateral ends of the fixing rotator in the axial direction thereof. Additionally, even if the slider produces the faulty linear streaks extending on the fixing rotator in the direction of rotation of the fixing rotator while the slider slides over the fixing rotator, the slider performs finishing to eliminate the faulty linear streaks, thus preventing formation of a faulty toner image that may be caused by the faulty linear streaks.

As described above, the controller controls and rotates the cam to cause the cam to press the slider against the outer circumferential surface of the fixing rotator at one lateral end (e.g., one of the rear end and the front end) of the fixing rotator in the axial direction thereof, so that the slider polishes the one lateral end of the fixing rotator. Since the slider does not polish another lateral end of the fixing rotator in the axial direction thereof, that may not degrade the toner image on the recording medium, the slider enhances durability.

As the controller rotates the cam to change the pressure with which the slider presses against the fixing rotator from increased pressure to decreased pressure smaller than the increased pressure, the slider engages the fixing rotator with a decreased engagement amount smaller than an increased engagement amount with which the slider engages the fixing rotator while the slider presses against the fixing rotator with the increased pressure, thus preventing variation in gloss of the toner image on the recording medium. Accordingly, the controller rotates the cam to prohibit the slider from polishing another lateral end of the fixing rotator in the axial direction thereof, which does not suffer from surface roughness that may damage the toner image on the recording medium, thus improving durability of the fixing rotator.

Similarly, since the slider suffers from degradation in performance after polishing, the controller rotates the cam to prohibit the slider from contacting another lateral end of the fixing rotator in the axial direction thereof, which does not suffer from surface roughness that may damage the toner image on the recording medium, thus improving durability of the slider.

Additionally, the controller controls the cam to press the slider against the fixing rotator selectively with the increased pressure or the decreased pressure. Accordingly, when the cam presses the slider against the fixing rotator with the increased pressure, the slider engages the fixing rotator with the increased engagement amount. Consequently, the slider eliminates the faulty gloss degradation streaks extending on the outer circumferential surface of the fixing rotator in the direction of rotation thereof, which are caused by the burred lateral edge of the recording medium. However, after the slider polishes the fixing rotator, the slider may leave the faulty linear streaks extending in the direction of rotation of the fixing rotator on the outer circumferential surface of the fixing rotator.

Conversely, when the cam presses the slider against the fixing rotator with the decreased pressure, the slider engages the fixing rotator with the decreased engagement amount. Consequently, the slider slightly eliminates the faulty gloss degradation streaks extending on the outer circumferential surface of the fixing rotator in the direction of rotation thereof, which are caused by the burred lateral edge of the recording medium. To address this circumstance, after the slider polishes the fixing rotator, the slider eliminates the faulty linear streaks extending in the direction of rotation of the fixing rotator on the outer circumferential surface of the fixing rotator, which are caused by the slider sliding over the fixing rotator during polishing.

Various sensors or the like may be used as a position detector that detects the position of the cam (e.g., the first slide position, the second slide position, the third slide position, and the isolation position). The controller (e.g., the driving controller 14) controls the position detector.

Figure 11:
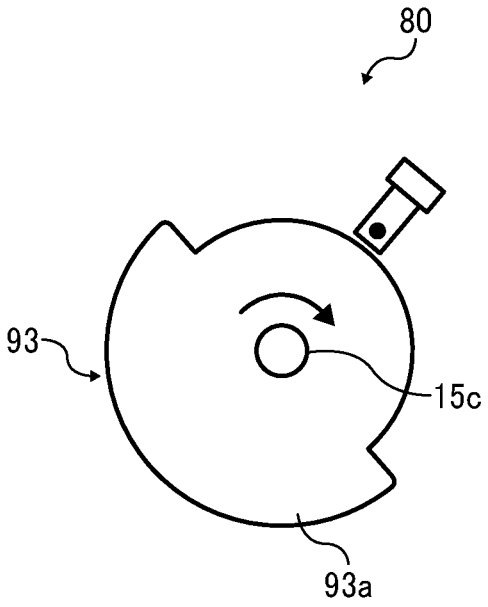
FIG. 11 is a partial vertical cross-sectional view of the fixing device depicted in FIG. 2, illustrating a position detector incorporated therein.

FIG. 11 is a partial vertical cross-sectional view of the fixing device 80. As illustrated in FIG. 11, the fixing device 80 includes a position detector 93 that detects the position of the cam 15. The position detector 93 is a photo sensor including an illuminator that emits light and a feeler 93*a* that blocks the light emitted by the illuminator. The feeler 93*a* is rotatably mounted on the driving shaft 15*c* of the cam 15.

The present disclosure is not limited to the details of the example embodiments described above and various modifications and improvements are possible.

According to the example embodiments described above, the fixing belt 2 serves as a fixing rotator. Alternatively, a fixing roller, a fixing film, a fixing sleeve, or the like may be used as a fixing rotator. The pressure roller 3 serves as an opposed rotator. Alternatively, a pressure belt or the like may be used as an opposed rotator.

The present disclosure has been described above with reference to specific example embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative example embodiments may be combined with each other and/or substituted for each other within the scope of the present disclosure.

What is claimed is:

1. A fixing device comprising:

a fixing rotator being rotatable in a given direction of rotation;

an opposed rotator to press against the fixing rotator to form a fixing nip between the fixing rotator and the opposed rotator, the fixing nip through which a recording medium bearing a toner image is conveyed;

a slider being rotatable to slide over an outer circumferential surface of the fixing rotator to polish and finish the fixing rotator;

a cam being rotatable to press the slider against the outer circumferential surface of the fixing rotator, the cam including:

a cam rear disposed opposite a rear end of the fixing rotator in an axial direction of the fixing rotator; and a cam front disposed opposite a front end of the fixing rotator in the axial direction of the fixing rotator; and a controller, coupled to the cam, to rotate the cam to a first slide position where the cam rear presses the slider against the fixing rotator, a second slide position where the cam rear and the cam front press the slider against the fixing rotator, a third slide position where the cam front presses the slider against the fixing rotator, and an isolation position where the cam rear and the cam front do not press the slider against the fixing rotator.

2. The fixing device according to claim 1, further comprising:

a bracket mounting the slider and being pivotable to move the slider with respect to the fixing rotator.

3. The fixing device according to claim 2, wherein the controller rotates the cam to the first slide position, the second slide position, and the third slide position while the bracket brings the slider into contact with the fixing rotator.

4. The fixing device according to claim 2, wherein the controller rotates the cam to the first slide position, the second slide position, and the third slide position while the bracket separates the slider from the fixing rotator.

5. The fixing device according to claim 2, wherein the controller rotates the cam to the first slide position, the second slide position, and the third slide position where the cam presses the slider against the fixing rotator with decreased pressure to cause the slider to finish the fixing rotator.

6. The fixing device according to claim 5, wherein the controller rotates the cam to the first slide position, the second slide position, and the third slide position where the cam presses the slider against the fixing rotator with increased pressure greater than the decreased pressure to cause the slider to polish the fixing rotator.

7. The fixing device according to claim 6, wherein the slider includes:

a cored bar; and an abrasive grain layer mounted on the cored bar and including:

a binder resin; and abrasive grains dispersed in the binder resin.

8. The fixing device according to claim 7, wherein the abrasive grains project from an outer circumferential surface of the abrasive grain layer to define surface asperities.

9. The fixing device according to claim 7, wherein as the slider presses against the fixing rotator with the increased pressure, the abrasive grains of the slider engage the fixing rotator with an increased engagement amount.

10. The fixing device according to claim 9, wherein as the slider presses against the fixing rotator with the decreased pressure, the abrasive grains of the slider engage the fixing rotator with a decreased engagement amount smaller than the increased engagement amount.

11. The fixing device according to claim 1, wherein the controller is coupled to the slider to rotate the slider at a rotation speed higher than a rotation speed of the fixing rotator.

12. The fixing device according to claim 1, wherein the fixing rotator includes an endless belt.

13. The fixing device according to claim 1, wherein the opposed rotator includes a pressure roller.

14. The fixing device according to claim 1, wherein the slider includes a slide roller.

15. The fixing device according to claim 1, further comprising:

a position detector to detect the cam disposed at the first slide position, the second slide position, the third slide position, and the isolation position.

16. An image forming apparatus comprising:

an image forming device to form a toner image; and a fixing device, disposed downstream from the image forming device in a recording medium conveyance direction, to fix the toner image on a recording medium, the fixing device including:

a fixing rotator being rotatable in a given direction of rotation;

an opposed rotator to press against the fixing rotator to form a fixing nip between the fixing rotator and the opposed rotator, the fixing nip through which the recording medium bearing the toner image is conveyed;

a slider being rotatable to slide over an outer circumferential surface of the fixing rotator to polish and finish the fixing rotator;

a cam being rotatable to press the slider against the outer circumferential surface of the fixing rotator, the cam including:

a cam rear disposed opposite a rear end of the fixing rotator in an axial direction of the fixing rotator; and a cam front disposed opposite a front end of the fixing rotator in the axial direction of the fixing rotator; and a controller, coupled to the cam, to rotate the cam to a first slide position where the cam rear presses the slider against the fixing rotator, a second slide position where the cam rear and the cam front press the slider against the fixing rotator, a third slide position where the cam front presses the slider against the fixing rotator, and an isolation position where the cam rear and the cam front do not press the slider against the fixing rotator.

* * * * *